US010060261B2

(12) United States Patent
Arima et al.

(10) Patent No.: US 10,060,261 B2
(45) Date of Patent: Aug. 28, 2018

(54) ROTARY SYNCHRONIZED COMBUSTION ENGINE

(71) Applicants: Takayuki Arima, Tokyo (JP); Takero Arima, Torrance, CA (US)

(72) Inventors: Takayuki Arima, Tokyo (JP); Takero Arima, Torrance, CA (US)

( * ) Notice: Subject to any disclaimer, the term of this patent is extended or adjusted under 35 U.S.C. 154(b) by 135 days.

(21) Appl. No.: 15/129,984

(22) PCT Filed: Apr. 19, 2015

(86) PCT No.: PCT/US2015/026567

§ 371 (c)(1),
(2) Date: Sep. 28, 2016

(87) PCT Pub. No.: WO2015/164223

PCT Pub. Date: Oct. 29, 2015

(65) Prior Publication Data

US 2017/0159438 A1 Jun. 8, 2017

Related U.S. Application Data

(63) Continuation of application No. PCT/US2014/035560, filed on Apr. 25, 2014.

(51) Int. Cl.
*F01C 1/12* (2006.01)
*F01C 21/08* (2006.01)
(Continued)

(52) U.S. Cl.
CPC ..... *F01C 1/123* (2013.01); *F01C 21/08* (2013.01); *F02B 53/10* (2013.01); *F02B 53/12* (2013.01); *F02M 26/41* (2016.02)

(58) Field of Classification Search
CPC ..... F01C 1/123; F01C 21/08; F02B 53/12; F02B 53/10; F02M 26/41
(Continued)

(56) References Cited

U.S. PATENT DOCUMENTS 808,255 A * 12/1905 Philipon ..... F01C 1/20 418/196
1,949,723 A * 3/1934 Kotelevtseff ..... F02B 53/00 417/440
(Continued)

FOREIGN PATENT DOCUMENTS

DE 2232505 A1 2/1973

OTHER PUBLICATIONS

International Search Report and Written Opinion on PCT/US2014/035560.
(Continued)

*Primary Examiner* — J Todd Newton
(74) *Attorney, Agent, or Firm* — LambentIP

(57) ABSTRACT

An engine system is provided, including a housing, multiple shafts in alignment and in parallel with each other, vertically penetrating through the housing, multiple wing sections integratively attached around the multiple shafts, respectively, and configured to engage with each adjacent one to drive axial rotation, and multiple ducts attached to the housing and communicating with inside of the housing, each duct being for use for passing an air-fuel mixture or outputting exhaust gases. The air-fuel mixture is collected in at least two open sections associated with the first wing section, and the collected air-fuel mixture is compressed and ignited for combustion when each of the at least two open sections has a minimum volume. Chemical energy generated by the combustion is used to drive the axial rotation of each wing section, thereby individually rotating the multiple shafts to transmit power.

8 Claims, 12 Drawing Sheets

(51) Int. Cl.
*F02M 26/41* (2016.01)
*F02B 53/10* (2006.01)
*F02B 53/12* (2006.01)

(58) Field of Classification Search
USPC ..... 123/200–249, 43 A, 43 R, 45 A, 18 A, 123/18 R; 418/140, 187, 61.1
See application file for complete search history.

(56) References Cited

U.S. PATENT DOCUMENTS 2,246,235 A * 6/1941 Beach ..... F02B 53/00 123/203
3,538,893 A * 11/1970 Tinsley ..... F02B 53/00 123/246
3,640,252 A * 2/1972 Spinnett ..... F02B 53/00 123/232
3,777,723 A * 12/1973 Lundstrom ..... F01C 1/20 123/246
3,863,610 A * 2/1975 Spinnett ..... F01C 1/20 123/204
4,003,349 A * 1/1977 v. Habsburg-Lothringen ..... F01C 1/18 123/246
4,144,004 A * 3/1979 Edwards ..... F01C 21/18 418/185
5,520,147 A * 5/1996 Secord ..... F01C 1/20 123/210
9,353,679 B2 * 5/2016 Hruschka ..... F01C 1/20
9,435,203 B2 * 9/2016 South ..... F01C 1/084
2005/0109309 A1 * 5/2005 Lockett ..... F01C 1/123 123/202

OTHER PUBLICATIONS

International Search Report and Written Opinion on PCT/US2015/026567.

* cited by examiner

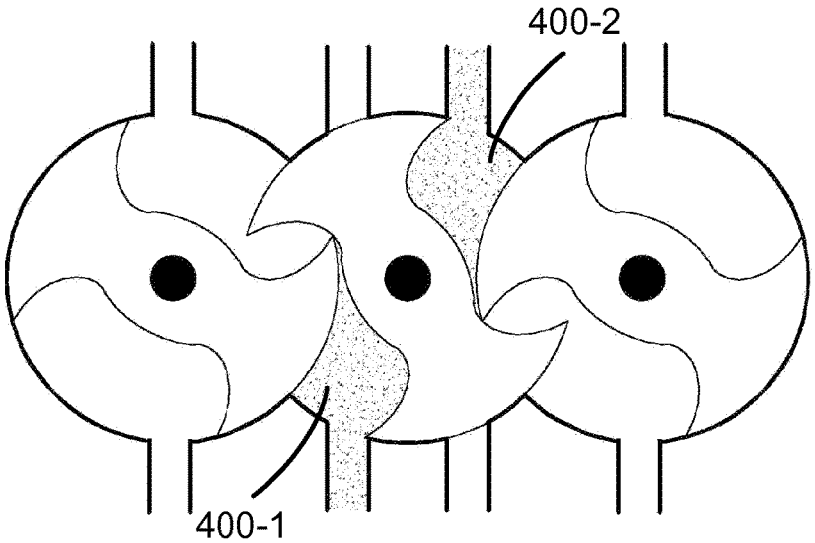
FIG. 4G
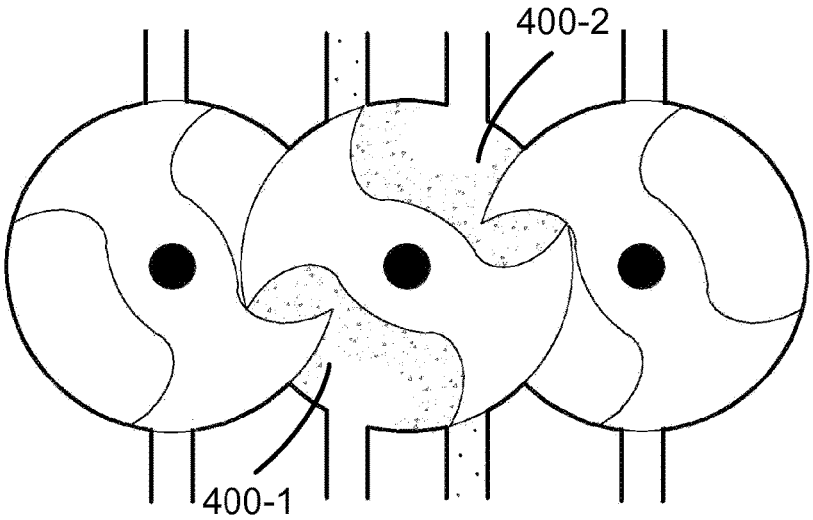
FIG. 4H
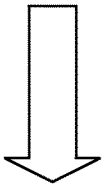
To FIG. 4B

ROTARY SYNCHRONIZED COMBUSTION ENGINE

CROSS REFERENCE

This PCT application claims the benefit of PCT application No. PCT/US2014/035560, filed on Apr. 25, 2014.

BACKGROUND

The internal combustion engine generally refers to a type of engine, in which the combustion of a fuel occurs with an oxidizer in a combustion chamber. The oxidizer is typically air. The fuels commonly include hydrocarbons, and are derived from fossil fuels such as diesel, gasoline and petroleum gas. The expansion of the high-temperature and high-pressure gases produced by the combustion exerts direct force to mechanical components such as pistons, turbine blades, nozzles and the like, thereby moving these components. In short, engines are configured to transform chemical energy into mechanical energy.

Most internal combustion engines that are designed for gasoline use can run on natural gas, hydrogen gas or liquefied petroleum gases. Liquid and gaseous biofuels such as ethanol and biodiesel can also be used. Biodiesel is produced from crops that yield triglycerides such as soybean oil. So called producer gas, which is made from biomass, can also be used. Examples of next-generation fuels include shale gas, which may offer a low-cost energy solution with eco-friendly chemical reaction.

In view of ever increasing needs for energy saying and eco-friendliness as well as the drive to reduce dependency on foreign-produced oil, designs of highly efficient engines are desired to utilize new types of fuels at their full potential.

BRIEF DESCRIPTION OF THE DRAWINGS

FIGS. 4A-4H illustrate key steps of the process of the rotary synchronized combustion engine according to an embodiment.

Figure 1:
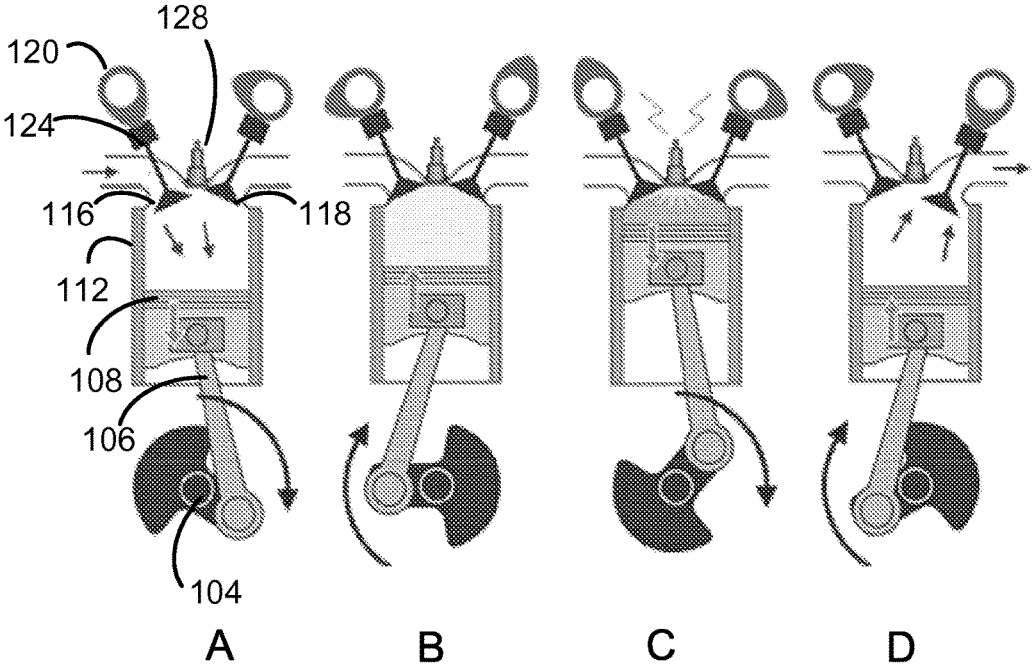
Prior Art FIG. 1
FIG. 1 illustrates an example of the conventional four-cycle process.

These drawings are provided to assist in understanding of the embodiments of the rotary synchronized combustion engine as described in detail below. In particular, the relative spacing, positioning, sizing and dimensions of various elements illustrated in the drawings are not drawn to scale. Those of ordinary skill in the art will appreciate that a number of alternative configurations exist but are omitted herein for clarity.

DETAILED DESCRIPTION

In a typical internal combustion engine, the combustion is intermittent as exemplified by the four-cycle, two-cycle or six-cycle process. FIG. 1 illustrates an example of the conventional four-cycle process in which four basic steps are repeated with two revolutions of the engine. These four steps are: (A) intake step, (B) compression step, (C) power step, and (D) exhaust step.

In FIG. 1, the rotational movement generated by a crankshaft 104 actuates the linear movement of a piston 108 via a connecting rod 106. The initial rotational movement may be driven by a starter motor, for example. In the intake step A, the piston 108 moves downward in a cylinder 112, which forms a combustion chamber, to maximize the volume within the cylinder 112 above the piston 108, thereby creating a low pressure therein. An inlet valve 116 opens by a cam lobe 120 pressing down a valve stem 124, while an outlet valve 118 is closed. A mixture of fuel and air is sucked into the combustion chamber by atmospheric or greater pressure into the cylinder 112 where the pressure is low. The inlet valve 116 closes at the end of this step.

In the compression step B, the inlet valve 116 and the outlet valve 118 are closed, and the piston 108 moves upward in the cylinder 112 to minimize the volume within the cylinder 112 above the piston 108, thereby compressing the air-fuel mixture therein. During this compression process, pressure, temperature and the density of the air-fuel mixture increase.

In the power step C, the piston 108 is close to the top of the cylinder 112, and the air-fuel mixture is compressed to the minimum volume and ignited by a spark plug 128. The expansion of gases by the combustion of the air-fuel mixture pushes the piston 108 and the connecting rod 106 downward in the cylinder 112, producing power to rotate the crankshaft 104.

In the exhaust step D, the piston 118 moves upward from the position where the maximum volume within the cylinder 112 above the piston 118 is created, and the outlet valve 118 opens to allow the exhaust gases to escape the cylinder 112. At the end of this step, the outlet valve 118 closes, the inlet valve 114 opens, and the sequence of the steps A-D repeats in the next cycle.

In the four-cycle process of a conventional internal combustion engine as depicted above, the four steps are carried out sequentially, and the conversion between the rotational movement of the crankshaft and the linear movement of the piston is repeated for transmission of the power generated by the combustion. Thus, the efficiency is inherently low. In view of the problems associated with the fundamental engine mechanism, the present document describes a new type of engine that enables power transmission between rotational movements without involving linear movements. The engine structure is configured to allow for only rotational movements of the parts, including reversible rotational movements, and to synchronize multiple combustions within a cycle. Details of such rotary synchronized combustion engines according to present embodiments are explained below with reference to the subsequent drawings.

Figures 2A, 2B:
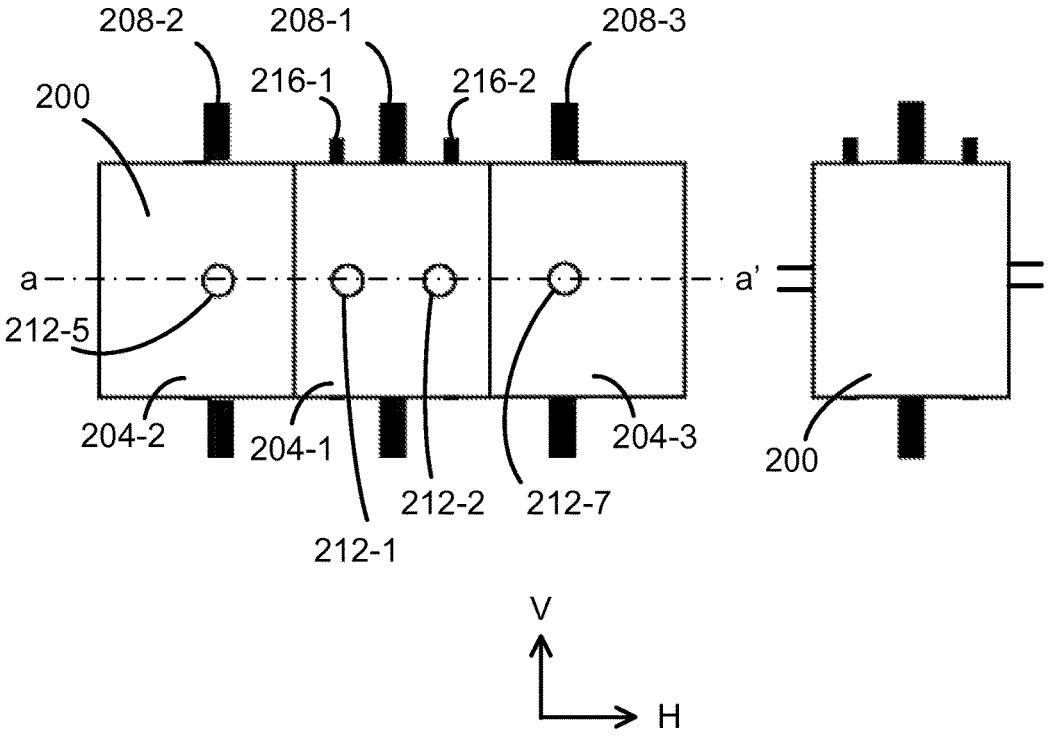
FIG. 2 illustrates the structure of an example of the rotary synchronized combustion engine according to an embodiment.
Figure 2C:
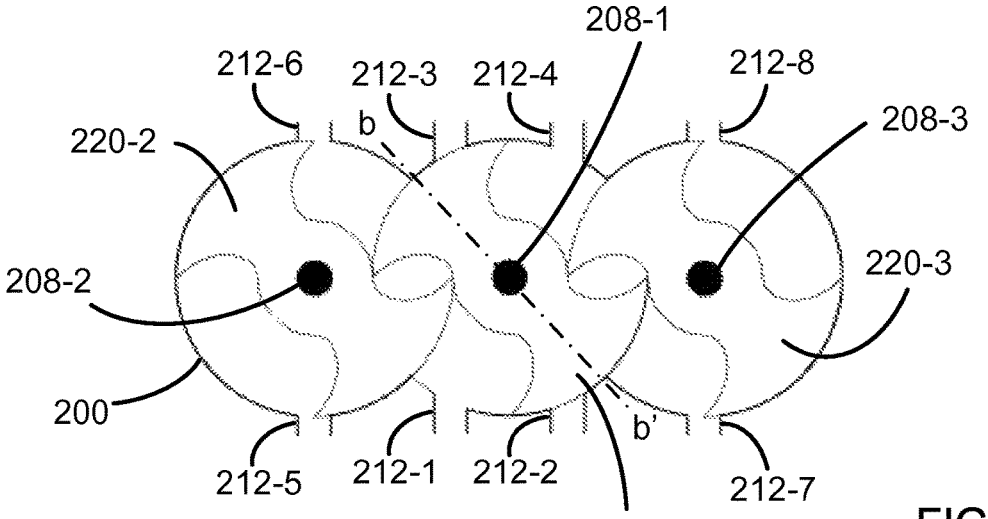
Figure 2D:
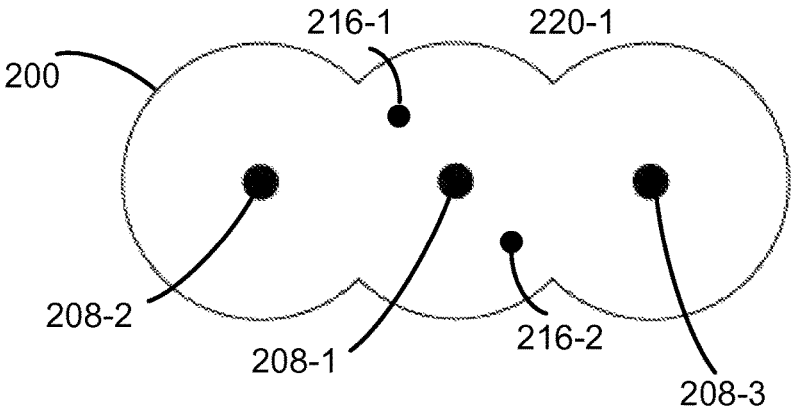
Figure 2E:
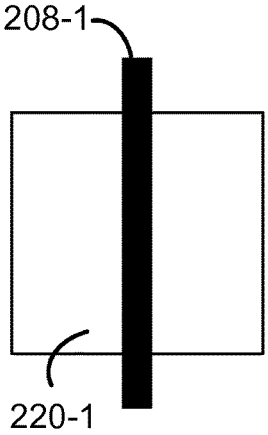

FIGS. 2A-2E illustrate the structure of an example of the rotary synchronized combustion engine according to an embodiment, separately illustrating a front view in FIG. 2A, a side view in FIG. 2B, a cross-sectional view in FIG. 2C with respect to the plane indicated by dash-dot line a-a' in FIG. 2A, a top view in FIG. 2D, and a cross-sectional view in FIG. 2E with respect the plane indicated by dash-dot line b-b' in FIG. 2C. The internal parts of the engine are accommodated in a housing 200, which has a shape of enveloping a combination of three cylinders, which have substantially the same dimensions, merged side-by-side to overlap partially with each adjacent one by keeping the three top surfaces level as well as the bottom surfaces level. The housing 200 has a side section, which is formed uniformly along the vertical direction, and top and bottom sections in the horizontal direction. Each of the side section, the top section and the side section has an internal surface and an external surface. A first cylindrical section 204-1 that is a center section of the housing 200 and a second cylindrical section 204-2 and a third cylindrical section 204-3 of the housing 200 have respective cylindrical axes, each of which is an axis of symmetry of the cylinder. The vertical direction V and the horizontal direction H are indicated in the inset of FIG. 2A. Along the axes of symmetry, first, second and third shafts 208-1, 208-2 and 208-3 are provided, respectively. Thus, these shafts are provided in alignment and in parallel with each other, vertically penetrating through the housing 200. The housing 200 is attached with eight ducts 212-1, 212-2 . . . and 212-8 communicating with the inside of the housing 200, each duct being for use for passing an air-fuel mixture or exhaust gases. All the eight ducts 212-1, 212-2 . . . and 212-8 are seen in the cross sectional view in FIG. 2C; the four ducts 212-1, 212-2, 212-5 and 212-7 provided in the front side section of the housing 200 are seen in the front view in FIG. 2A. The first and second ducts 212-1 and 212-2 are attached to the front side section of the first cylindrical section 204-1 of the housing 200; and the third and fourth ducts 212-3 and 212-4 are attached to the back side section of the first cylindrical section 204-1 of the housing 200. The fifth duct 212-5 is attached to the front side section of the second cylindrical section 204-2 of the housing 200; the sixth duct 212-6 is attached to the back side section of the second cylindrical section 204-2 of the housing 200. The seventh duct 212-7 is attached to the front side section of the third cylindrical section 204-3 of the housing 200, and the eighth duct 212-8 is attached to the back side section of the third cylindrical section 204-3 of the housing 200. Two spark plugs 216-1 and 216-2 are provided to the first cylindrical section 204-1 of the housing 200 for igniting the air-fuel mixture in two open sections, respectively, in the first cylindrical section 204-1 of the housing 200. These two spark plugs 216-1 and 216-2 may be attached to the top section of the first cylindrical section 214-1 as exemplified in FIGS. 2A and 2D; alternatively, one of them may be attached to the top section and the other may be attached to the bottom section, or both of them may be attached to the bottom section of the first cylindrical section 204-1.

Each shaft is provided along the cylindrical axis of each cylindrical section of the housing 200, and a wing section is integratively attached around each shaft. Specifically, as seen in the cross sectional view in the FIG. 2C, the first cylindrical section 204-1 accommodates a first wing section 220-1 integratively attached around the first shaft 208-1, the second cylindrical section 204-2 accommodates a second wing section 220-2 integratively attached around the second shaft 208-2, and the third cylindrical section 204-3 accommodates a third wing section 220-3 integratively attached around the third shaft 208-3. Each wing section is configured to be vertically uniform along the shaft, as illustrated in FIG. 2E, which illustrates the vertical cross-sectional shape of the first wing section 220-1 and the first shaft 208-1 with respect to the plane indicated by b-b' in FIG. 2C. Only the shaft and the wing section are illustrated in FIG. 2E for clarity, by omitting the outlines of the housing 200 and the other parts.

Each wing section is configured so that the first wing section 220-1 engages with the second wing section 220-2 at one side and the third wing section 220-3 at the other side to drive the axial rotation of the second wing section 220-2 and the third wing section 220-3 when the first wing section 220-1 axially rotates with the rotation of the first shaft 208-1. An example is illustrated in FIG. 2C, wherein the horizontal cross-sectional shape of each wing section is configured to be symmetric with respect to a vertical plane including the center axis of the shaft and to have two edge portions, each edge portion spanning along a part of the internal side surface of the corresponding cylindrical section of the housing 200. Both edge portions of each wing section are configured to be in contact with the internal side surface of the corresponding cylindrical section of the housing 200, and yet able to rotate freely within the corresponding cylindrical section of the housing 200. Lubrication oil or any other suitable material or technique may be used for that purpose. Each edge portion is configured to be wider than the portion near and around the shaft.

Figure 3:
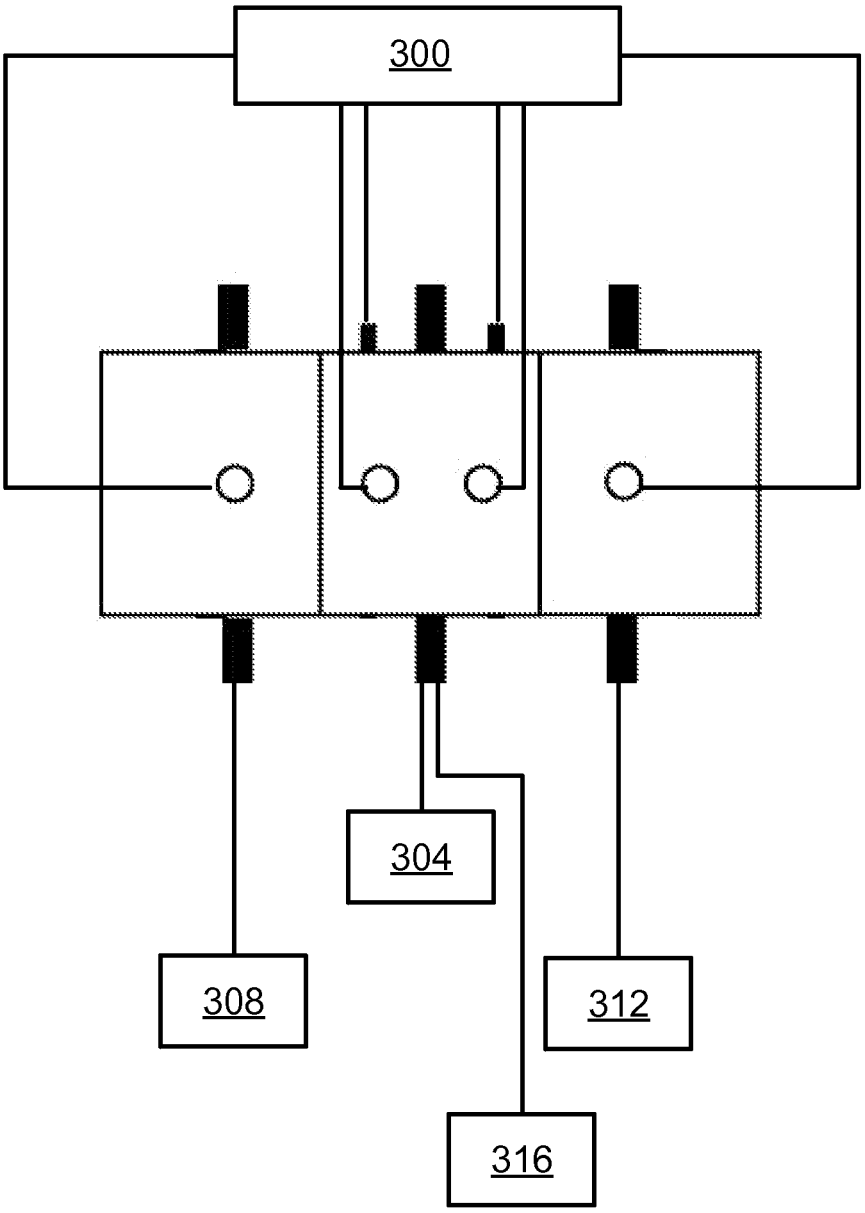
FIG. 3 is a block diagram illustrating a system including the rotary synchronized combustion engine according to an embodiment.

FIG. 3 is a block diagram illustrating a system including the rotary synchronized combustion engine according to an embodiment. The reference numerals for the engine parts are the same as those used in FIG. 2, and omitted in FIG. 3 for clarity. The system includes various units additional to the engine unit to enable the engine process. A controller 300 including a CPU and/or a computer program may be coupled to various parts of the engine to control associated functions. For example, the controller 300 is coupled to the eight ducts 212-1, 212-2 . . . and 212-8 to control the input and output timings, pressure and other parameters associated with the air-fuel mixture and exhaust gases. One or more of the ducts 212-1, 212-3 . . . and 212-8 may include one or more valves, respectively, the open/close of which may also be controlled by the controller 300. The controller 300 is further coupled to the spark plugs 216-1 and 216-2 to control the ignition timings. The first shaft 208-1 may be coupled to a starter motor 304 that drives the initial rotation of the first shaft 208-1. Instead of using a starter motor, the initial rotation may be driven manually or by other means as configured by those skilled in the art. The second shaft 208-2 and the third shaft 208-3 are coupled to mechanical parts 308 and 312, respectively, to transmit power in the form of the rotational energy of the second and third shafts 208-2 and 208-3 to the mechanical parts 308 and 312, respectively. The first shaft 208-1 is coupled to a mechanical part 316 to transmit power in the form of the rotational energy of the first shaft 208-1 to the mechanical part 316 once the engine process started.

FIGS. 4A-4H illustrate sequential steps of the engine process of the rotary synchronized combustion engine according to an embodiment. The reference numerals for the engine parts and other parts in the system are the same as those used in FIGS. 2 and 3, and thus omitted in FIGS. 4A-4H.

Figure 4A:
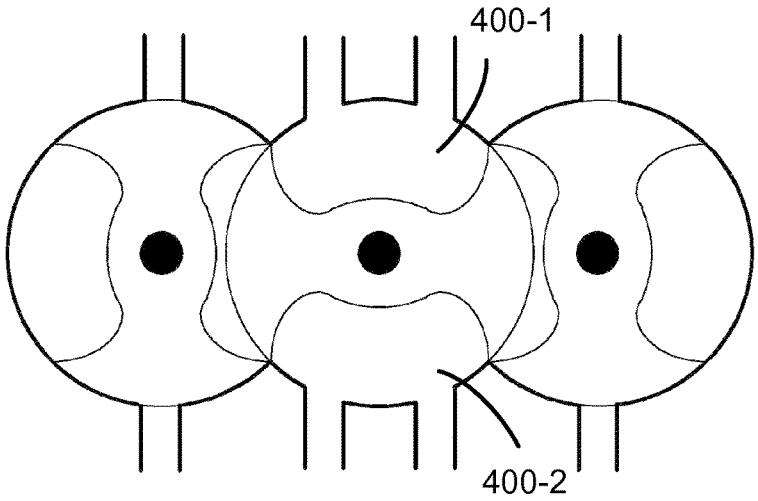

FIG. 4A illustrates a configuration of the engine parts before starting, wherein the first wing section 220-1 is oriented substantially orthogonal to the second wing section 220-2 and the third wing section 220-3, which are oriented substantially in parallel to each other. Here, the second wing section 220-2 is oriented so as to close the ducts 212-5 and 212-6 attached to the second cylindrical section 204-2, and the third wing section 220-3 is oriented so as to close the ducts 212-7 and 212-8 attached to the third cylindrical section 204-3, while the ducts 212-3 and 212-4 attached to the back side section of the first cylindrical section 204-1 communicate with an first open section 400-1, and the ducts 212-1 and 212-2 attached to the front side section of the first cylindrical section 204-1 communicate with a second open section 400-2. Here, the first open section 400-1 and the second open section 400-2 are two open sections associated with the first wing section 200-1, each open section surrounded by the first wing section 220-1 and the first cylindrical section 204-1 of the housing 200.

Figure 4B:
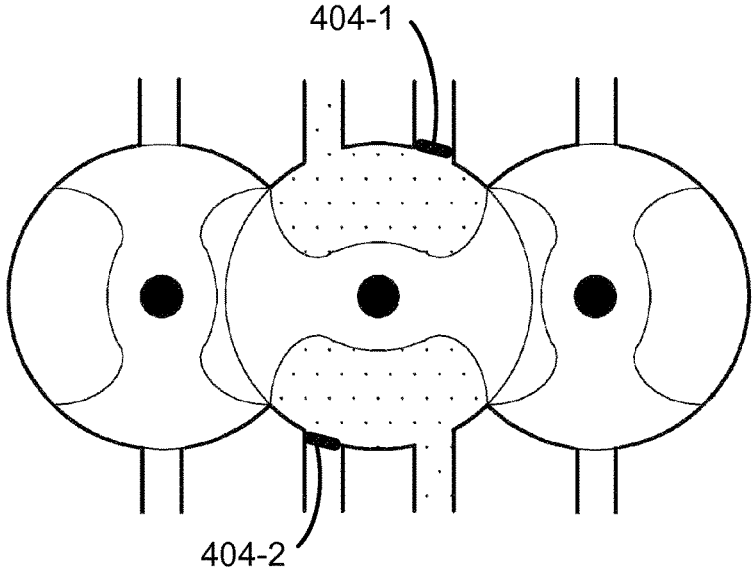

FIG. 4B illustrates a configuration of the engine parts when the counter-clockwise rotation of the first wing section 220-1 is about to be started with the initial rotation of the first shaft 208-1 by the starter motor 304, for example. The air-fuel mixture is injected as soon as the rotation starts so as to fill the first open section 400-1 and the second open section 400-2. The third duct 212-3 serves as an inlet to input the air-fuel mixture to the first open section 400-1, and the second duct 212-2 serves as an inlet to input the air-fuel mixture to the second open section 400-2. The fourth duct 212-4 and the first duct 212-1 may be closed by using respective valves 404-1 and 404-2, so that the inputted air-fuel mixture does not escape through these ducts. The controller 300 may be configured to control the open/close of these valves. Alternatively to using valves, the rotation speed of the first wing section 220-1 may be adjusted so that the first wing section 220-1 rotates counter-clockwise fast enough to close the fourth duct 212-4 and first duct 212-1 before the inputted air-fuel mixture reaches these ducts to escape.

Figure 4C:
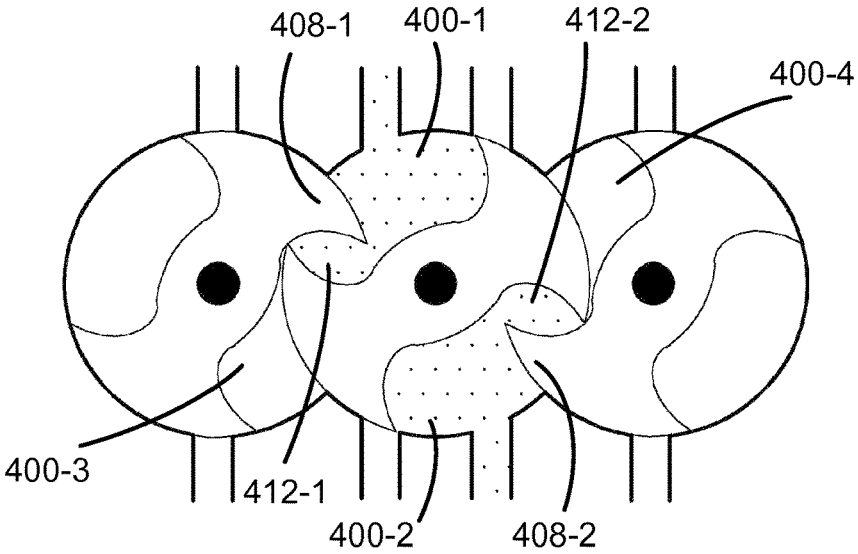

FIG. 4C illustrates a configuration of the engine parts, wherein the first wing section 220-1 has rotated counter-clockwise to reach the orientation to close the fourth duct 212-4 and first duct 212-1, while the third duct 212-3 and the second duct 212-2 are still open as inlets for inputting the air-fuel mixture. Due to the frictional force between the first wing section 220-1 and the second wing section 220-2, the second wing section 220-2 rotates clockwise. Similarly, due to the frictional force between the first wing section 220-1 and the third wing section 220-3, the third wing section 220-3 rotates clockwise. As mentioned earlier with reference to (C) of FIG. 2, the edge portions of each wing section are configured to be wider than the portion near and around the shaft. Therefore, in the configuration of FIG. 4C, the volume of the first open section 400-1 is reduced by the amount of a first projection 408-1, which is a portion of the edge portion of the second wing section 220-2, the portion projecting into the first open section 400-1. Similarly, the volume of the second open section 400-2 is reduced by the amount of a second projection 408-2, which is a portion of the edge portion of the third wing section 220-3, the portion projecting into the second open section 400-2. In spite of the reduced volume of each of the open sections 400-1 and 400-2, the air-fuel mixture may be controlled to keep entering the open sections 400-1 and 400-2 by adjusting the external pressure to be higher than inside the open sections 400-1 and 400-2. Here, the controller 300 including a CPU and/or a computer program may be configured to control the input and output timings, pressure and other parameters associated with the air-fuel mixture. Accordingly, the density of the air-fuel mixture in the open sections 400-1 and 400-2 can be maintained or controlled to even increase instead of decrease. At the same time, the first open section 400-1 starts overlapping with a third open section 400-3, which is one of the open sections associated with the second wing section 220-2 and surrounded by the second wing section 220-2 and the second cylindrical section 204-2 of the housing 200. Through the overlap portion 412-1, some of the air-fuel mixture is channeled from the first open section 400-1 to the third open section 400-3. Similarly, the second open section 400-2 starts overlapping with a fourth open section 400-4, which is one of the open sections associated with the third wing section 220-3 and surrounded by the third wing section 220-3 and the third cylindrical section 204-3 of the housing 200. Through the overlap portion 412-2, some of the air-fuel mixture is channeled from the second open section 400-2 to the fourth open section 400-4.

Figure 4D:
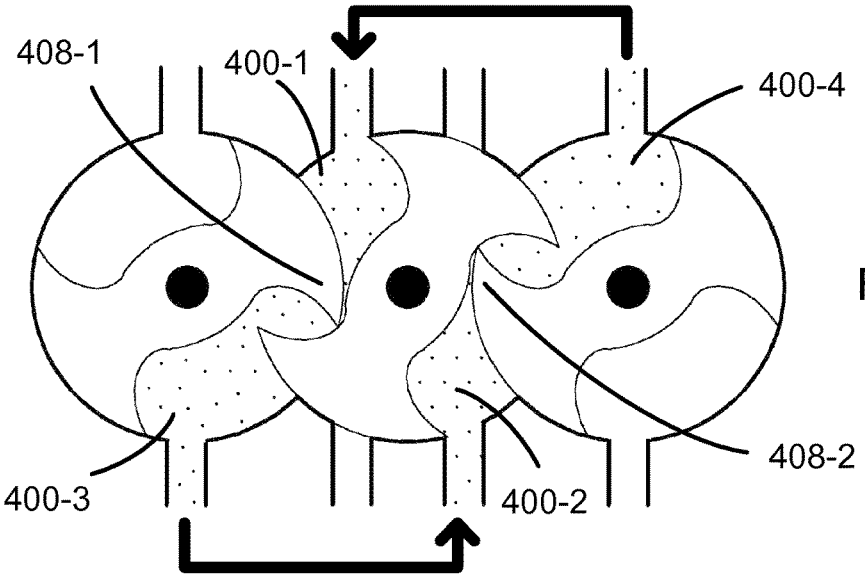

FIG. 4D illustrates a configuration of the engine parts, wherein the first wing section 220-1 has further rotated counter-clockwise, and the second and third wing sections 220-2 and 220-3 have further rotated clockwise, until the first projection 408-1 touches the first wing section 220-1 to close the channel between the first open section 400-1 and the third open section 400-3, and the second projection 408-2 touches the first wing section 220-1 to close the channel between the second open section 400-2 and the fourth open section 400-4. The air-fuel mixture may still be inputted through the third and first ducts 212-3 and 212-1, to fill the first and second open sections 400-1 and 400-2 by using a higher external pressure than the pressure inside the first and second open sections 400-1 and 400-2. Additionally, the air-fuel mixture in the third open section 400-3 may be transferred to the second open section 400-2, and the air-fuel mixture in the fourth open section 400-4 may be transferred to the first open section 400-1, as indicated by solid arrow lines in FIG. 4D. As a result, the air-fuel mixture is collected only in the first and second open sections 400-1 and 400-2 associated with the first wing sections 220-1. Therefore, the system configuration according to the present embodiment allows for efficient use of the air-fuel mixture, by minimizing the escape thereof from the system. The transfer mechanism may be configured by using additional ducts allowing for the channeling between the fifth duct 212-5 and the second duct 212-2 and between the eight-duct 212-8 and the third duct 212-3, wherein the channeling timings may be controlled by the controller 300 via opening and closing of associated valves. Any technique for transferring the air-fuel mixture with precise timings can be utilized as conceived by a person of ordinary skill in the art.

Figure 4E:
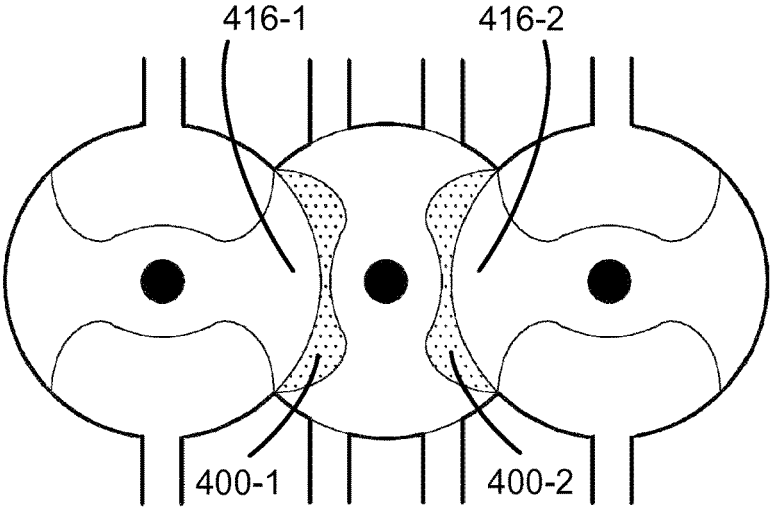

FIG. 4E illustrates a configuration of the engine parts, wherein the first wing section 220-1 has further rotated counter-clockwise to orient substantially orthogonal to the second wing section 220-2 and the third wing section 220-3, which are oriented substantially in alignment with each other. Here, the first wing section 220-1 is oriented so as to close the first-fourth ducts 212-1-212-4 attached to the first cylindrical section 204-1. The first open section 400-1 is closed by a first edge portion 416-1 of the second wing section 220-2; and the second open section 400-2 is closed by a second edge portion 416-2 of the third wing section 220-3. Each edge portion is configured to cylindrically span along a part of the internal side surface of the cylindrical section of the housing 200, in which the edge portion is located. Thus, in the configuration of FIG. 4E, the first edge portion 416-1 projects into the first open section 400-1 and closes the first open section 400-1 to have the minimum volume among all possible volumes. Similarly, the second edge portion 416-2 projects into the second open section 400-2 and closes the second open section 400-2 to have the minimum volume among all possible volumes. Due to the transfer of the air-fuel mixture indicated in FIG. 4D, the amount of the air-fuel mixture in the first and second open sections 400-1 and 400-2 in FIG. 4E is substantially the same as the total amount injected into the first-fourth open section 400-1-400-4 indicated in FIG. 4D. The air-fuel mixture is thus compressed within the smallest possible volume, giving rise to the highest density in the configuration of FIG. 4E among all possible configurations. That is, the air-fuel mixture inputted inside the housing 200 is collected in the two open sections associated with the first wing section 220-1, and compressed when each of the two open sections has a minimum volume.

Figure 4F:
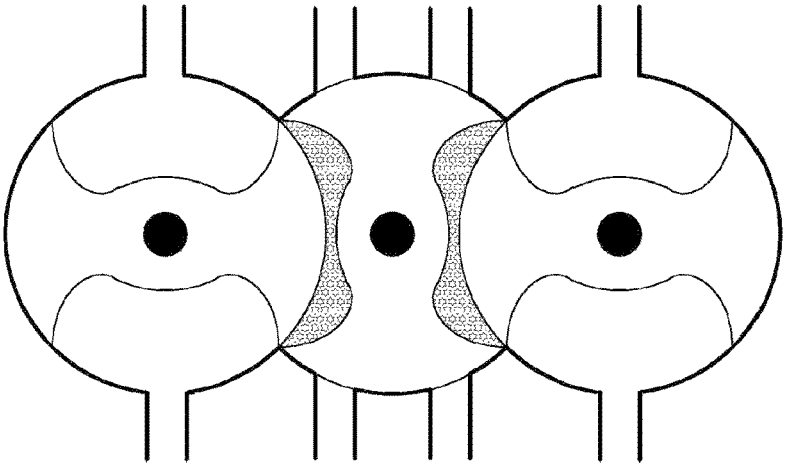

FIG. 4F illustrates a configuration of the engine parts, wherein the compressed air-fuel mixture in the first and second open section 400-1 and 400-2 gets ignited by the spark plugs 216-1 and 216-2, respectively. The timings of ignition may be controlled by the controller 300. The expansion of gases by the combustion of the air-fuel mixture produces power to push further the counter-clockwise rotation of the first wing section 220-1, which engages the second and third wing sections 220-2 and 220-3 to drive the clockwise rotation thereof. As a result, the first, second and third shafts 208-1, 208-2 and 208-3 axially rotate individually, thereby transmitting power in the form of the rotational power to external parts to be utilized for performing various functions. It should be noted that the engine parts in this example are configured to have two synchronized combustions that can produce larger energy at once than in the case of sequential combustions. This scenario is analogous to having a two-cylinder engine as opposed to having a one-cylinder engine.

FIG. 4G illustrates a configuration of the engine parts, wherein the first wing section 220-1 has further rotated to the orientation where the first wing section 220-1 closes the third duct 212-3 and the second duct 212-2, while the first open section 400-1 communicates with the first duct 212-1 and the second open section 400-2 communicates with the fourth duct 212-4 for allowing the exhaust gases to escape. The high internal pressure after the combustion will naturally push out the exhaust gases. Alternatively, the external pressure may be adjusted to be lower than the internal pressure to suck out the exhaust gases. The controller 300 may be configured to control the timings, pressure and other parameters associated with the exhaust gases.

FIG. 4H illustrates a configuration of the engine parts, wherein the first wing section 220-1 has further rotated to the orientation where the first wing section 220-1 still closes the third duct 212-3 and the second duct 212-2, the first open section 400-1 still communicates with the first duct 212-1, and the second open section 400-2 still communicates with the fourth duct 212-4. It is indicated in this figure that almost all the exhaust gases have been outputted from the first and second open sections 400-1 and 400-2 through the first duct and the fourth duct, respectively, and a fresh air-fuel mixture is ready to be inputted through the third duct 212-3 and the second duct 212-2.

After the configuration illustrated in FIG. 4H, the first, second and third wing sections 220-1, 220-2 and 220-3 further rotate to assume the configuration illustrated in FIG. 4B, where the air-fuel mixture is inputted to the first and second open sections 400-1 and 400-2, and the process depicted in FIG. 4B-4H repeats.

As explained with reference to FIGS. 4A-4H above, the expansion of gases by the combustion of the air-fuel mixture produces power to push further the counter-clockwise rotation of the first wing section 220-1, which engages the second and third wing sections 220-2 and 220-3 to drive the clockwise rotation thereof. As a result, the first, second and third shafts 208-1, 208-2 and 208-3 axially rotate individually, thereby transmitting power in the form of the rotational energy to external parts to be utilized for performing various functions. In a conventional internal combustion engine such as illustrated in FIG. 1, the expansion of gases by the combustion of the air-fuel mixture pushes the piston 108 and the connecting rod 106 downward in the cylinder 112, producing power to rotate the crankshaft 104, whereby the power is transmitted to external parts only through one transmission path, and both linear and rotational motions are involved. In contrast, in the present rotary synchronized combustion engine, the first, second and third shafts 208-1, 208-2 and 208-3 axially rotate individually, thereby transmitting power in the form of the rotational energy through three different transmission paths.

Figure 5:
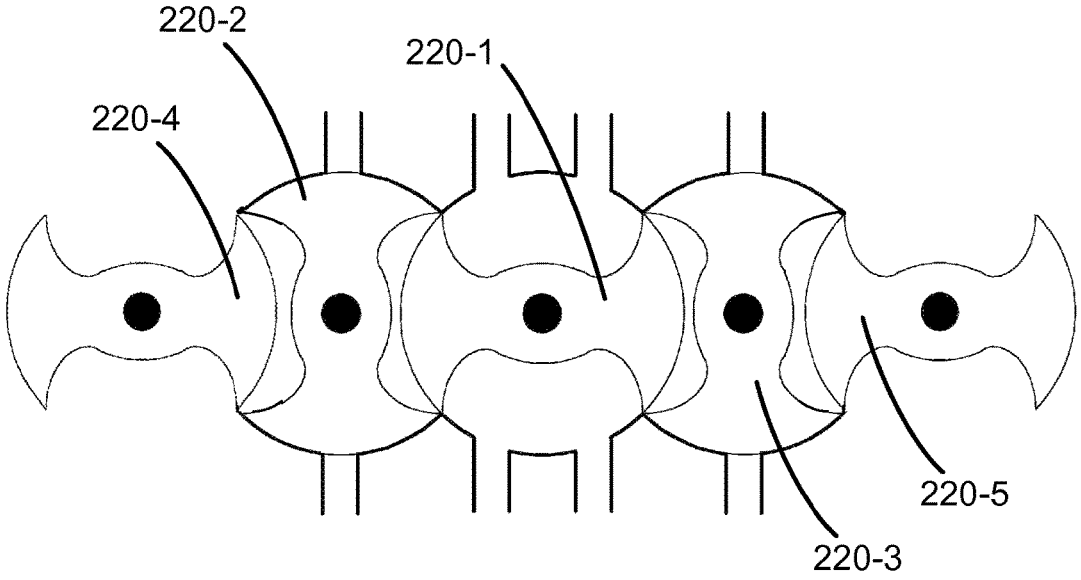
FIG. 5 illustrates an example in which a fourth wing section is provided to engage with the second wing section and a fifth wing section is provided to engage with the third wing section.

It is possible to increase the number of power transmission paths by providing one or more additional wing sections with respective additional shafts. FIG. 5 illustrates an example in which a fourth wing section 220-4 is provided to engage with the second wing section 220-2 and a fifth wing section 220-5 is provided to engage with the third wing section 220-3. The axial rotation of the first wing section 220-1 drives the axial rotation of the second wing section 220-2, which in turn drives the axial rotation of the fourth wing section. Similarly, the axial rotation of the first wing section 220-1 drives the axial rotation of the third wing section 220-3, which in turn drives the axial rotation of the fifth wing section 220-5. The one or more wing sections may be sequentially engaged with the second wing section 220-2, the third wing section 220-3 or both. The number of additional wing sections on the left may be the same as or different from the number of additional wing sections on the right. The total number of additional wing sections can be determined according to the needed number of power transmission paths and the needed power amounts transmitted through respective transmission paths.

A conventional internal combustion engine such as illustrated in FIG. 1 operates to sequentially perform the steps in the cycle. In contrast, in the present rotary synchronized combustion engine, the compressed air-fuel mixture in two combustion chambers, i.e., the first open section 400-1 and the second open section 400-2, are ignited simultaneously by the two spark plugs 216-1 and 216-2, respectively, as illustrated in FIG. 4F. Therefore, the engine parts are configured to have two synchronized combustions that can produce larger energy at once than in the case of conventional sequential combustions. This scenario is analogous to having a two-cylinder engine as opposed to having a one-cylinder engine.

In the present example of the rotary synchronized combustion engine, the engine parts are configured to have two open sections for combustion. However, it is possible to configure the wing sections 220-1, 220-2 and 220-3 to have three or more open sections to compress the air-fuel mixture, thereby providing three or more combustion chambers. The number of ducts and the shape of each wing section need to be configured so that the air-fuel mixture does not leak to unwanted open sections and does not mix with the exhaust gases in any open section of the housing. Furthermore, multiple spark plugs need to be respectively provided to simultaneously ignite the air-fuel mixture in the multiple open sections for synchronized combustions. This scenario is analogous to having a multiple-cylinder engine as opposed to having a one-cylinder engine.

In view of the above possible variations, the rotary synchronized combustion engine having multiple power transmission paths and multiple combustion chambers may be configured by including: a housing; multiple shafts provided in alignment and in parallel with each other, vertically penetrating through the housing; multiple wing sections integratively attached around the multiple shafts, respectively, and configured to engage with one or two adjacent wing sections to drive axial rotation, wherein a horizontal cross-sectional shape of each wing section is configured to have at least two edge portions, each edge portion configured to span along and in contact with a part of an internal surface of the housing during the axial rotation; and multiple ducts attached to the housing and communicating with inside of the housing, each duct being for use for passing an air-fuel mixture or exhaust gases, wherein at least four of the multiple ducts are configured to communicate with at least two open sections associated with a first wing section of the plurality of wing sections. The air-fuel mixture is collected in the at least two open sections inside the housing, and the collected air-fuel mixture is compressed and ignited for combustion when each of the at least two open sections has a minimum volume. Accordingly, the chemical energy generated by the combustion is used to drive the axial rotation of each of the multiple wing sections, thereby individually rotating the multiple shafts to transmit power.

In the case of a conventional internal combustion engine such as illustrated in FIG. 1, the expansion of gases by the combustion of the air-fuel mixture pushes the piston 108 and the connecting rod 106 downward in the cylinder 112, producing power to rotate the crankshaft 104. That is, in the conventional case, the original chemical energy generated by the combustion first drives the linear motion, which is then transformed to the rotational motion of the crankshaft 104. In contrast, in the present rotary synchronized combustion engine, the original chemical energy generated by the combustion is transformed directly to rotational energy for rotating multiple wing sections attached to respective shafts. Therefore, higher efficiency can be achieved by using the present engine than the conventional engine, since the process of energy transformation has fewer steps, involving fewer parts.

In the preset rotary synchronized combustion engine, the number of power transmission paths can easily be increased by adding wing sections to be driven by the combustion in the center section, i.e., in the open sections associated with the first wing section. Additionally, the number of combustion chambers can also be increased by increasing the number of open sections associated with each wing sections, thereby increasing the power analogously to having a multiple-cylinder engine.

In the process illustrated in FIGS. 4A-4H, the initial rotation of the first wing section 220-1 is started counter-clockwise to subsequently repeat the counter-clockwise rotation of the first wing section 220-1 and the clockwise rotation of the second and third wing sections 220-2 and 220-3. Due to the symmetric configuration of the engine parts at rest, as illustrated in FIG. 4A, the initial rotation of the first wing section 220-1 can be started clockwise to subsequently repeat the clockwise rotation of the first wing section 220-1 and the counter-clockwise rotation of the second and third wing sections 220-2 and 220-3. That is, the rotation motion of each shaft is reversible in the present rotary synchronized combustion engine.

Figure 6A:
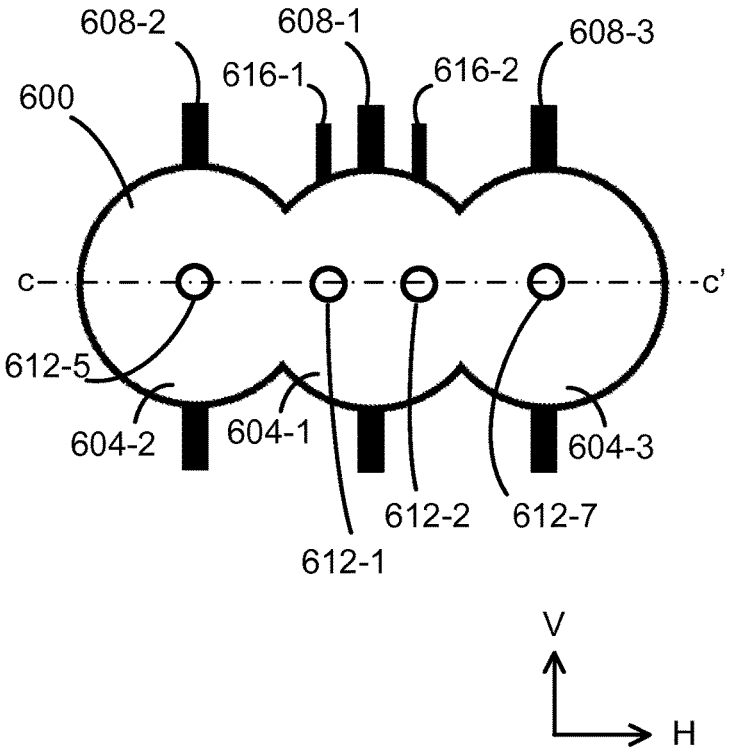
FIGS. 6A-6E illustrate the structure of another example of the rotary synchronized combustion engine according to an embodiment.
Figure 6B:
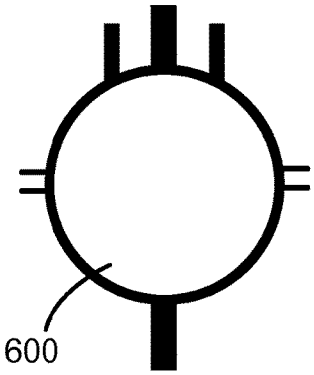
Figure 6C:
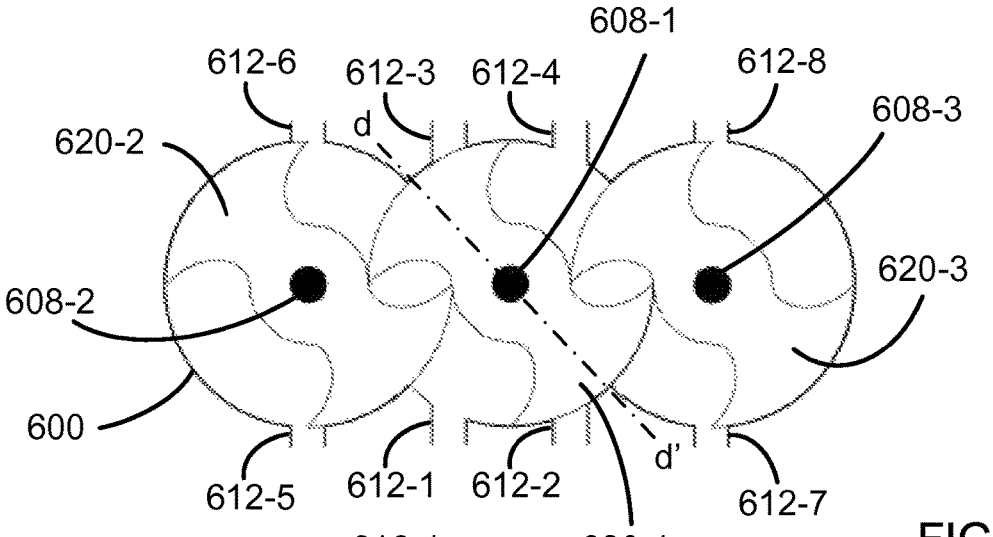
Figure 6D:
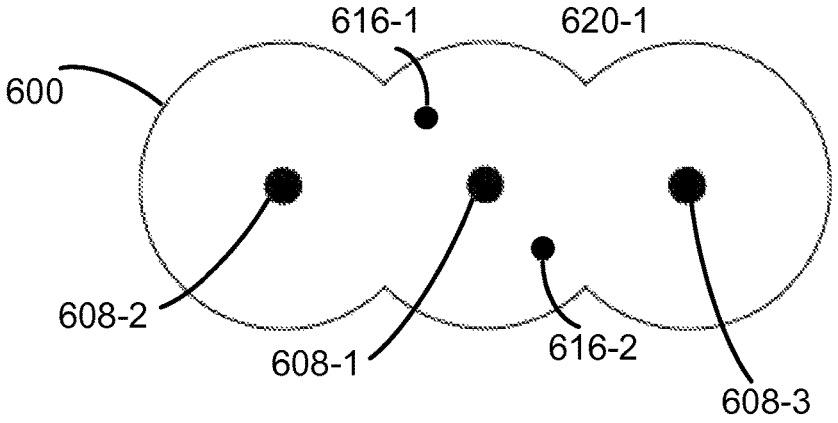
Figure 6E:
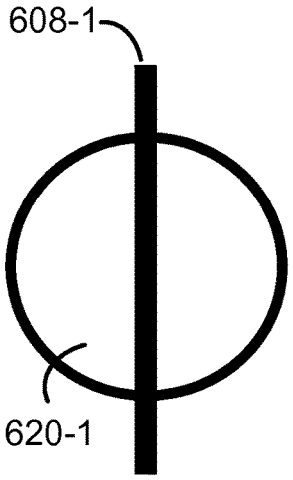

FIGS. 6A-6E illustrate the structure of another example of the rotary synchronized combustion engine according to an embodiment, separately illustrating a front view in FIG. 6A, a side view in FIG. 6B, a cross-sectional view in FIG. 6C with respect to the plane indicated by dash-dot line c-c' FIG. 6A, a top view in FIG. 6D, and a cross-sectional view in FIG. 6E with respect the plane indicated by dash-dot line d-d' in FIG. 6C. The internal parts of the engine are accommodated in a housing 600, which has a shape of enveloping a combination of three ellipsoids, which have substantially the same dimensions, merged side-by-side to overlap partially with each adjacent one. It should be understood by those skilled in the art that ellipsoidal shapes generally include a substantially spherical shape, which is used to illustrate the present example in FIG. 6A-6E and later drawings. The housing 600 has an internal surface and an external surface. A first ellipsoidal section 604-1 that is a center section of the housing 600, a second ellipsoidal section 604-2 and a third ellipsoidal section 604-3 of the housing 600 have respective ellipsoidal axes. Each ellipsoidal section has a pair of equal semi-axes in the horizontal plane and a third semi-axis which is an axis of symmetry in the vertical direction. Thus, the horizontal cross-sectional shape of each ellipsoidal section of the housing 600 is substantially a circle, merged side-by-side to overlap with each adjacent one. The ellipsoid can be prolate, i.e., elongated along the vertical direction, oblate, i.e., elongated along all the horizontal directions, or spherical. The vertical direction V and the horizontal direction H are indicated in the inset of FIG. 6A. Along the axes of symmetry, first, second and third shafts 608-1, 608-2 and 608-3 are provided, respectively. Thus, these shafts are provided in alignment and in parallel with each other, vertically penetrating through the housing 600. The housing 600 is attached with eight ducts 612-1, 612-2 . . . and 612-8 communicating with the inside of the housing 600, each duct being for use for passing an air-fuel mixture or exhaust gases. All the eight ducts 612-1, 612-2 . . . and 612-8 are seen in the cross-sectional view in FIG. 6C; the four ducts 612-1, 612-2, 612-5 and 612-7 provided in the front section of the housing 600 are seen in the front view in FIG. 6A. The first and second ducts 612-1 and 612-2 are attached to the front section of the first ellipsoidal section 604-1 of the housing 600; and the third and fourth ducts 612-3 and 612-4 are attached to the back section of the first ellipsoidal section 604-1 of the housing 600. The fifth duct 612-5 is attached to the front section of the second ellipsoidal section 604-2 of the housing 600; and the sixth duct 612-6 is attached to the back section of the second ellipsoidal section 604-2 of the housing 600. The seventh duct 612-7 is attached to the front section of the third ellipsoidal section 604-3 of the housing 600; and the eighth duct 612-8 is attached to the back section of the third ellipsoidal section 604-3 of the housing 600. Two spark plugs 616-1 and 616-2 are provided to the first ellipsoidal section 604-1 of the housing 600 for igniting the air-fuel mixture in two open sections, respectively, in the first ellipsoidal section 604-1 of the housing 600. These two spark plugs 616-1 and 616-2 may be attached to the top section of the first ellipsoidal section 614-1 as exemplified in FIGS. 6A and 6D; alternatively, one of them may be attached to the top section and the other may be attached to the bottom section, or both of them may be attached to the bottom section of the first ellipsoidal section 604-1.

As seen in the cross-sectional view in the FIG. 6C, the first ellipsoidal section 604-1 accommodates a first wing section 620-1 integratively attached around the first shaft 608-1, the second ellipsoidal section 604-2 accommodates a second wing section 620-2 integratively attached around the second shaft 608-2, and the third ellipsoidal section 604-3 accommodates a third wing section 620-3 integratively attached around the third shaft 608-3. Each wing section is formed conformal to the ellipsoidal shape having an axis of symmetry along the vertical direction, i.e., along the center axis of the corresponding shaft, as illustrated in FIG. 6E, which illustrates the vertical cross-sectional shape of the first wing section 620-1 and the first shaft 608-1 with respect to the plane indicated by d-d' in FIG. 6C. Only the shaft and the wing section are illustrated in FIG. 6E for clarity, by omitting the outlines of the housing 600 and the other parts.

Each wing section is configured so that the first wing section 620-1 engages with the second wing section 620-2 at one side and the third wing section 620-3 at the other side to drive the axial rotation of the second wing section and the third wing section 620-3 when the first wing section 620-1 axially rotates with the rotation of the first shaft 608-1. As seen in FIG. 6C, the horizontal cross-sectional shape of each section projected on the plane indicated by the line c-c' in FIG. 6A is configured to be symmetric with respect to a vertical plane including the center axis of the shaft and to have two edge portions, each edge portion spanning along a part of the internal surface of the corresponding ellipsoidal section of the housing 600. Both edge portions of each wing section are configured to be in contact with the internal surface of the corresponding ellipsoidal section of the housing 600, and yet able to rotate freely within the corresponding cylindrical section of the housing 600. Lubrication oil or any other suitable material or technique may be used for that purpose. The edge portion of the cross-sectional shape of each wing section is configured to be wider than the portion near and around the shaft.

Figure 7A:
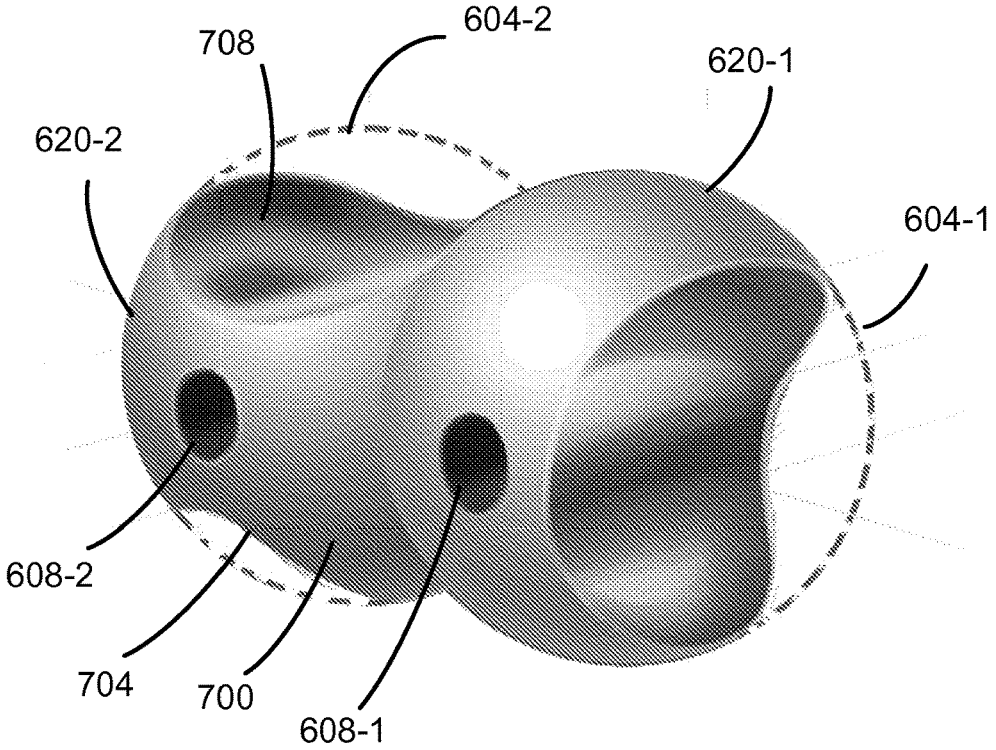
FIG. 7A illustrates a perspective view of a 3D configuration of the first wing section integrated around the first shaft and the second wing section integrated around the second shaft, wherein the first wing section and the second wing section are oriented substantially orthogonal to each other.
Figure 7B:
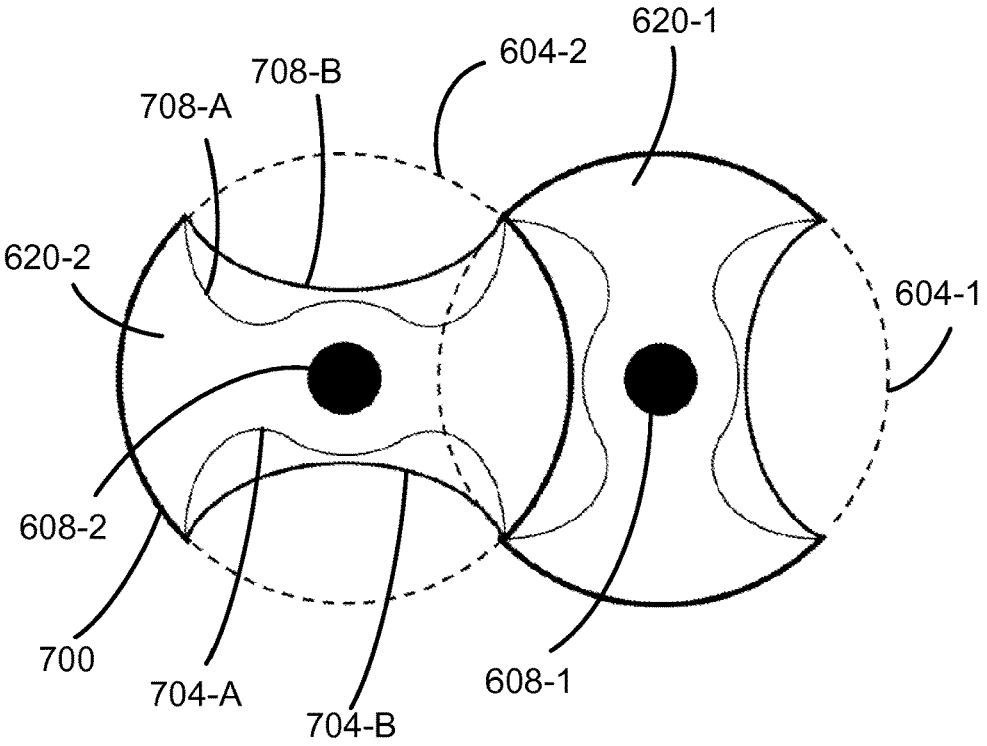
FIG. 7B is a schematic drawing of the configuration illustrated in FIG. 7A, when viewed along the vertical direction.

Examples of shapes and configurations of the wing sections of the structure in FIGS. 6A-6E are further explained with reference to subsequent drawings in FIGS. 7A, 7B, 8A and 8B. FIG. 7A illustrates a perspective view of a 3D configuration of the first wing section 620-1 integrated around the first shaft 608-1 and the second wing section 620-2 integrated around the second shaft 608-2, wherein the first wing section 620-1 and the second wing section 620-2 are oriented substantially orthogonal to each other. The third wing section 620-3 is omitted in FIG. 7A for simplicity; however, it should be assumed that the third wing section 620-3 is provided on the right side of and engaged with the first wing section 620-1 in this figure, and is oriented in the same direction as the second wing section 620-2. FIG. 7B is a schematic drawing of the configuration illustrated in FIG. 7A, when viewed along the vertical direction. In both FIGS. 7A and 7B, the outlines of the first ellipsoidal section 604-1 of the housing 600 and the second ellipsoidal section 604-2 of the housing 600 are illustrated in dashed lines. This configuration in FIGS. 7A and 7B corresponds to the configuration illustrated in FIG. 4E. In the previous example illustrated in FIG. 4E, each wing section is formed uniformly along the vertical direction, whereas in the present example illustrated in FIGS. 7A and 7B, each wing section is formed non-uniformly along the vertical direction.

The body shape of each wing section is explained below with reference to the second wing section 620-2 in FIGS. 7A and 7B. The second wing section 620-2, as well as each of the other wing sections, has a body shape which is defined by a first surface 700, a second surface 704 and a third surface 708, each of which is a curved surface. The first surface 700 is formed conformal to the internal surface of the second ellipsoidal section 604-2 of the housing 600. The second and third surfaces 704 and 708 have substantially the same curved shapes and are symmetric to each other with respect to a vertical plane including the center axis of the second shaft 608-2, i.e., the axis of symmetry of the second ellipsoidal section 604-2. The horizontal cross-sectional shape, projected on a horizontal plane orthogonal to the vertical axis, i.e., the axis of symmetry of the second ellipsoidal section 604-2, of each of the second and third surfaces 704 and 708 varies depending on the vertical position of the horizontal plane. The horizontal cross-sectional shapes 704-A and 708-A, projected on the horizontal plane across the center of the vertical axis, of the second surface 704 and the third surface 708, respectively, are schematically illustrated in FIG. 7B. That is, in the example illustrated in FIGS. 7A and 7B, the horizontal cross-sectional shape of the second wing section 620-2 projected on the horizontal plane across the center of the vertical axis is similar to the shape described in the previous example of FIGS. 2A-2E and 4A 4H. Specifically, the horizontal cross-sectional shape of the second wing section 620-2 is configured to be symmetric with respect to a vertical plane including the center axis of the second shaft 608-2 and to have two edge portions, each edge portion spanning along a part of the internal surface of the second ellipsoidal section 604-2 of the housing 600. Both edge portions of the second wing section 620-2 are configured to be in contact with the internal surface of the second ellipsoidal section 604-2 of the housing 600, and yet able to rotate freely therein. Each edge portion is configured to be wider than the portion near and around the shaft. As the position moves away from the center of the vertical axis, the horizontal cross-sectional shape of each wing section changes, whereby each of the second and third surfaces 704 and 708 is formed to have a curved surface surrounded by a continuous ridge. In FIG. 7B, these ridges of the second and third surfaces 704 and 708 are schematically depicted by the curves 704-B and 708-B, respectively.

Figure 8A:
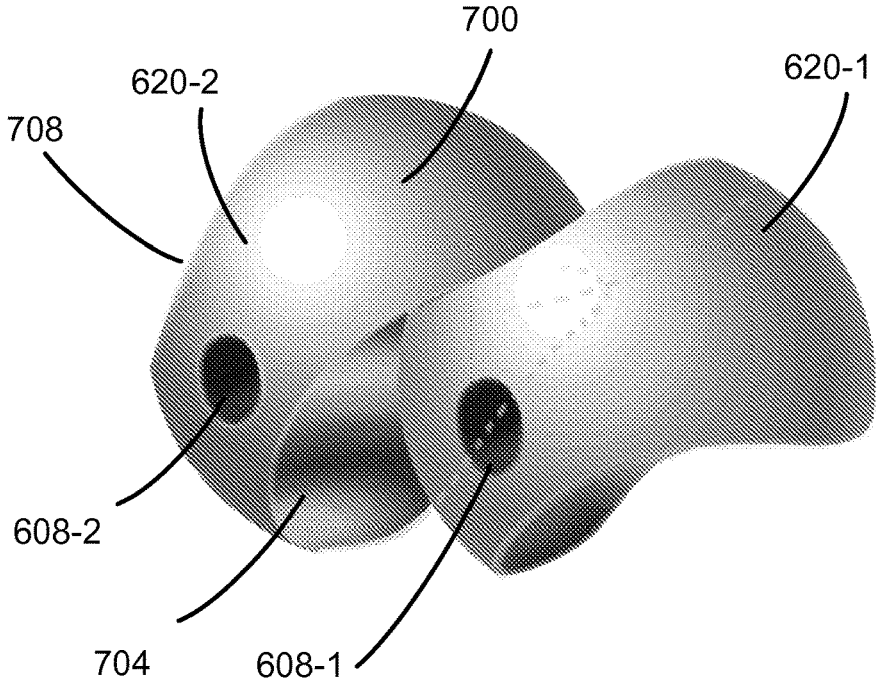
FIG. 8A illustrates a perspective view of another 3D configuration of the structure that is the same as the structure illustrated in FIGS. 7A and 7B, wherein the first wing section and the second wing section are rotated to the configuration corresponding to the configuration illustrated in FIG. 4D.
Figure 8B:
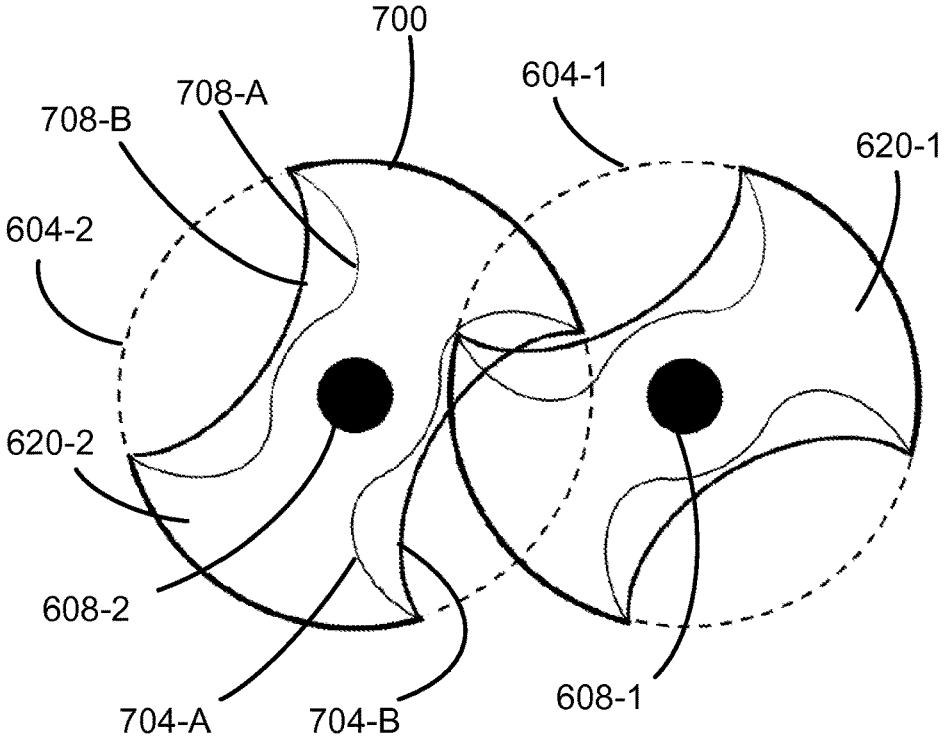
FIG. 8B is a schematic drawing of the configuration illustrated in FIG. 8A, when viewed along the vertical direction.

FIG. 8A illustrates a perspective view of another 3D configuration of the structure that is the same as the structure illustrated in FIGS. 7A and 7B, wherein the first wing section 620-1 and the second wing section 620-2 are rotated to the configuration corresponding to the configuration illustrated in FIG. 4D. The third wing section 620-3 is omitted in FIG. 8A for simplicity; however, it should be assumed that the third wing section 620-3 is provided on the right side of the first wing section 620-1 in this figure and is oriented in the same direction as the second wing section 620-2. FIG. 8B is a schematic drawing of the configuration illustrated in FIG. 8A, when viewed along the vertical direction. In FIG. 8B, the outlines of the first ellipsoidal section 604-1 of the housing 600 and the second ellipsoidal section 604-2 of the housing 600 are illustrated in dashed lines. The horizontal cross-sectional shapes 704-A and 708-A, projected on the horizontal plane across the center of the vertical axis, of the second surface 704 and the third surface 708, respectively, are schematically illustrated in FIG. 8B. Also in FIG. 8B, the ridges of the first and second surfaces 704 and 708 are schematically depicted by the curves 704-B and 708-B, respectively.

The engine process similar to the engine process illustrated in FIGS. 4A-4H can be carried out by using the engine structure illustrated in FIG. 6A-FIG. 8A, where the wing sections are configured to engage with one or two adjacent wing sections to drive axial rotation, wherein a horizontal cross-sectional shape of each wing section is configured to have at least two edge portions, each edge portion configured to span along and in contact with a part of the internal surface of the housing during the axial rotation. In the earlier example, the housing has a shape of enveloping a combination of multiple cylinders, which have substantially the same dimensions, merged side-by-side to overlap partially with each adjacent one by keeping respective top surfaces level as well as respective bottom surfaces level, and each wing section is formed vertically uniform along the shaft. On the other hand, in the later example, the housing has a shape of enveloping a combination of multiple ellipsoids, which have substantially the same dimensions, merged side-by-side to overlap partially with each adjacent one. The body shape of the wing section is defined by the first, second and third surfaces. The first surface is formed conformal to the internal surface of the housing, and the second and third surfaces are formed to be symmetric to each other with respect to a vertical plane including the center axis of the corresponding shaft, i.e., the axis of symmetry of the ellipsoid. Each of the second and third surfaces is formed to have a curved surface surrounded by a continuous ridge, whereby the air-fuel mixture is collected in at least two open sections associated with the first wing section in the housing, and the collected air fuel mixture is compressed and ignited for combustion when each of the at least two open sections has a minimum volume to generate chemical energy to drive the axial rotation of each of the multiple wing sections.

While this document contains many specifics, these should not be construed as limitations on the scope of an invention or of what may be claimed, but rather as descriptions of features specific to particular embodiments of the invention. Certain features that are described in this document in the context of separate embodiments can also be implemented in combination in a single embodiment. Conversely, various features that are described in the context of a single embodiment can also be implemented in multiple embodiments separately or in any suitable subcombination. Moreover, although features may be described above as acting in certain combinations and even initially claimed as such, one or more features from a claimed combination can in some cases be exercised from the combination, and the claimed combination may be directed to a subcombination or a variation of a subcombination.

What is claimed is:

1. An engine system comprising:

a housing;

a plurality of shafts provided in alignment and in parallel with each other, vertically penetrating through the housing;

a plurality of wing sections integratively attached around the plurality of shafts, respectively, and configured to engage with each adjacent wing section to drive axial rotation, wherein a horizontal cross-sectional shape of each wing section is configured to have at least two edge portions, each edge portion configured to span along and in contact with a part of an internal surface of the housing during the axial rotation; and a plurality of ducts attached to the housing and communicating with inside of the housing, each duct passing an air-fuel mixture or exhaust gases, wherein at least four of the plurality of ducts are configured to communicate with at least two open sections associated with a first wing section of the plurality of wing sections;

wherein the air-fuel mixture is collected in the at least two open sections associated with the first wing section inside the housing, and the collected air-fuel mixture is compressed and ignited for combustion when each of the at least two open sections has a minimum volume, and wherein chemical energy generated by the combustion is used to drive the axial rotation of each of the plurality of wing sections, thereby individually rotating the plurality of shafts to transmit power, wherein the plurality of wing sections include the first wing section, a second wing section configured to engage with the first wing section from one side and a third wing section configured to engage with the first wing section from the other side, wherein the first, second and third wing sections are integratively attached around a first shaft, a second shaft and a third shaft, respectively, wherein the first, second and third wing sections and the housing are configured to form first and second open sections associated with the first wing section, a third open section associated with the second wing section, and a fourth open section associated with the third wing section, and wherein the horizontal cross-sectional shape of each wing section is configured to have two edge portions, each edge portion configured to span along and in contact with a part of the internal surface of the housing during the axial rotation and to be wider than a portion near and around the shaft; and the plurality of ducts include a first duct, a second duct, a third duct, a fourth duct, a fifth duct, a sixth duct, a seventh duct and an eighth duct, wherein the first and second ducts communicate with the first open section or the second open section, the third and fourth ducts communicate with the first open section or the second open section, the fifth duct communicates with the third open section, the sixth duct communicates with the third open section, the seventh duct communicates with the fourth open section, and the eighth duct communicates with the fourth open section, wherein the engine system operates to have sequential configurations repeatedly as the axial rotation proceeds, the sequential configurations including:

a first configuration in which an initial rotation of the first shaft is provided to start the axial rotation of the first wing section, which drives the axial rotation of the second wing section and the third wing section;

a second configuration in which the air-fuel mixture is inputted to the first and second open sections through the third and second ducts, respectively;

a third configuration in which the first open section overlaps with the third open section and some of the air-fuel mixture is channeled from the first open section to the third open section through the overlap, and the second open section overlaps with the fourth open section and some of the air-fuel mixture is channeled from the second open section to the fourth open section through the overlap;

a fourth configuration in which a first projection associated with the edge portion of the second wing section touches the first wing section to close the channel between the first open section and the third open section, and a second projection associated with the edge portion of the third wing section touches the first wing section to close the channel between the second open section and the fourth open section, wherein the air-fuel mixture in the third open section is transferred to the second open section, and the air-fuel mixture in the fourth open section is transferred to the first open section, whereby the air-fuel mixture is collected in the first and second open sections which are associated with the first wing section;

a fifth configuration in which the first open section is closed by the edge portion of the second wing section and the second open section is closed by the edge portion of the third wing section, whereby each of the first and second open sections has the minimum volume to compress the collected air-fuel mixture;

a sixth configuration in which the compressed air-fuel mixture in the first and second open sections gets ignited for combustion; and a seventh configuration in which the exhaust gases generated by the combustion are outputted from the first open section through the first duct and from the second open section through the fourth duct.

2. The engine system of claim 1, wherein the housing has a shape of enveloping a combination of a plurality of cylinders, which have substantially the same dimensions, merged side-by-side to overlap partially with each adjacent one; and each wing section is formed vertically uniform along the shaft.

3. The engine system of claim 1, wherein the housing has a shape of enveloping a combination of a plurality of ellipsoids, which have substantially the same dimensions, merged side-by-side to overlap partially with each adjacent one; and each wing section is defined by first, second and third surfaces, wherein the first surface is formed conformal to the internal surface of the housing, and the second and third surfaces are formed to be symmetric to each other with respect to a vertical plane including a center axis of the corresponding shaft, and each of the second and third surfaces is formed to have a curved surface surrounded by a continuous ridge.

4. The engine system of claim 1, wherein the axial rotation is reversible.

5. The engine system of claim 1, further comprising:

a controller configured to control input and output timings, pressure and other parameters associated with the air-fuel mixture and the exhaust gases.

6. The engine system of claim 1, further comprising:

a starter motor to provide the initial rotation of the first shaft to start the axial rotation of the first wing section.

7. The engine system of claim 1, further comprising:

one or more valves coupled to one or more of the plurality of ducts, respectively.

8. The engine system of claim 1, further comprising:

at least two spark plugs configured to ignite the compressed air-fuel mixture for combustion in the at least two open sections, respectively.

* * * * *